United States Patent [19]

Gross

[11] Patent Number: 4,941,273

[45] Date of Patent: Jul. 17, 1990

[54] SHOE WITH AN ARTIFICIAL TENDON SYSTEM

[75] Inventor: Theodore S. Gross, Stony Brook, N.Y.

[73] Assignee: Converse Inc., North Reading, Mass.

[21] Appl. No.: 277,680

[22] Filed: Nov. 29, 1988

[51] Int. Cl.[5] ..... A43B 5/00; A43B 7/32

[52] U.S. Cl. ..... 36/114; 36/58.5; 36/68; 36/105; 36/129; 128/80 R

[58] Field of Search ..... 36/114, 36 R, 58.5, 36/58.6, 89, 105, 129, 68, 69; 128/80 R, 611

[56] References Cited

U.S. PATENT DOCUMENTS

| | | | |
|---|---|---|---|
| 477,958 | 6/1892 | Powell et al. | 36/58.5 |
| 2,525,237 | 10/1950 | Park . | |
| 2,607,131 | 8/1952 | Everston | 36/105 |
| 2,847,991 | 8/1958 | Andrews . | |
| 2,935,798 | 5/1960 | Piberhofer | 36/58.5 |
| 3,313,046 | 4/1967 | Werner et al. . | |
| 3,810,318 | 5/1974 | Epstein | 36/105 |
| 4,294,238 | 10/1981 | Woodford . | |
| 4,331,152 | 5/1982 | Bartoli | 128/80 R |
| 4,382,342 | 5/1983 | Spademan . | |
| 4,426,796 | 1/1984 | Spademan . | |
| 4,494,324 | 1/1985 | Spademan . | |
| 4,513,520 | 4/1985 | Koch . | |
| 4,559,722 | 12/1985 | Norton | 36/114 X |
| 4,565,017 | 1/1986 | Ottieri . | |
| 4,685,226 | 8/1987 | Olivieri et al. . | |

FOREIGN PATENT DOCUMENTS

| | | | |
|---|---|---|---|
| 1901772 | 8/1970 | Fed. Rep. of Germany | 36/58.5 |
| 29781 | of 1910 | United Kingdom | 36/58.5 |
| 821065 | 9/1959 | United Kingdom | 36/68 |
| 2114869 | 9/1983 | United Kingdom | 36/114 |

OTHER PUBLICATIONS

Rosemount Ski Boot Instructional Manual, 1965, Rosemount Engineering Co., 12001 West 78th St., Eden Prairie, Minn. 55345.

*Primary Examiner*—James Kee Chi

*Attorney, Agent, or Firm*—Bromberg & Sunstein

[57] ABSTRACT

A shoe has an artificial tendon system, including an elastic band extending through a passageway in the midsole of the shoe. One end of the elastic band is attached to the midsole within the passageway near the forefoot area and the other end is attached near the heel area of the shoe. When the shoe is used, extension of the elastic band stores energy during heelstrike and early propulsion and releases energy during toeoff.

4 Claims, 3 Drawing Sheets

SHOE WITH AN ARTIFICIAL TENDON SYSTEM

TECHNICAL FIELD

The invention relates to a shoe, especially an athletic shoe, including a midsole arrangement having an elastic band that functions as an artificial tendon by facilitating the storage and release of tension created and released during the running cycle.

BACKGROUND OF THE INVENTION

The prior art includes several devices that must somehow be attached to the leg of the wearer. U.S. Pat. No. 4,294,238 describes a lower limb muscle aid device in which an elastic strap is secured at one end around the foot of the wearer and at the other end around the leg of the wearer below the knee. U.S. Pat. No. 2,525,237 discloses a brace for supporting the foot of persons afflicted with various forms of paralysis. The purpose of this device is to provide additional support to the leg, ankle, and foot of the wearer. U.S. Pat. No. 2,847,991 discloses a drop foot brace having a rigid arch support plate for disposition beneath the foot of the wearer at one end and a U-shaped ankle support at the other end thereof. Like the '237 device, this device's purpose is to provide support to the leg, ankle and foot of the wearer. All of these devices require some means of attachment to the leg of the wearer. The prior art also includes ski boots, as in U.S. Pat. Nos. 3,313,046 and 4,382,342, which use adjustable webbing or cables to provide support to the foot and ankle of the skier. Because of the nature of ski boots, these devices clearly cannot facilitate the storage and release of tension created and released during a running cycle. There remains a need for an internally disposed system that will aid the wearer during the running cycle by preferentially storing and releasing the energy generated during the running cycle in a manner beneficial to the runner.

SUMMARY OF THE INVENTION

A shoe is provided that includes an artificial tendon system. The system includes a midsole having a longitudinal axis, a heel area and a forefoot area. The midsole has a passageway therethrough along the longitudinal axis of the midsole. A band of elastic material extends through the passageway in the midsole. The first end of the band is anchored in the forefoot area of the midsole. A retaining arrangement for securing the second end of the band is disposed proximate to the heel area of the midsole so that the band may be secured under tension when the shoe is secured on the foot of a wearer. With both ends of the band secured, extension of the elastic material during heel strike and early propulsion creates tension in the band, which tension is released during toe off.

DETAILED DESCRIPTION OF THE DRAWINGS

Figure 1:
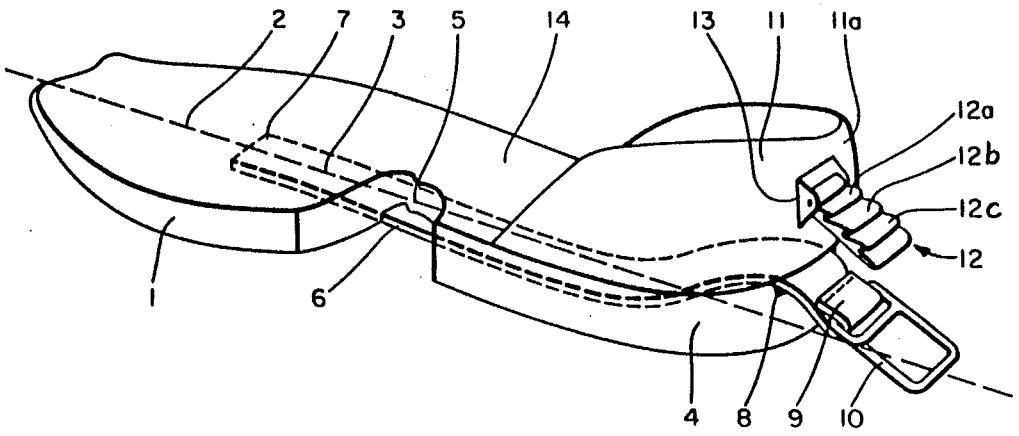
FIG. 1 shows a perspective side view including a cutaway portion in the midfoot area thereof of a midsole of a shoe according to a preferred embodiment of the invention.

FIG. 1 shows a midsole according to a preferred embodiment of the invention. The midsole has a longitudinal axis 3, a forefoot area 2 and a heel area 4. A passageway 5 extends partially through the midsole 1 along the longitudinal axis 3. An elastic band 6 is disposed within the passageway 5 and is anchored at one end 7 in the forefoot area 2 forward of the metatarsal heads.

From the anchored end 7 the elastic band 6 extends through the passageway 5 along the longitudinal axis 3 of the midsole 1 passing beneath the midfoot area 14 and exiting the midsole 1 through an opening 8 in the heel area 4 of the midsole 1. A second end 9 of the elastic band 6 has a retaining clip 10 attached thereto.

In a preferred embodiment a heel counter 11 is disposed proximate to the heel area 4 of the midsole 1. The heel counter 11 can either be permanently affixed to the heel area 4 of the midsole 1 or can be a removable structure. A buckle 12 is pivotably attached to a bracket 13 which is secured to the outer perimeter of the heel counter 11. The buckle 12 has notches **12*a*, 12*b* and 12*c* by which the retaining clip 10 can be fastened. In this fashion, tension on the elastic band 6 can be adjusted to suit the wearer's needs by securing the retaining clip 10 to the buckle notches 12*a*, 12*b* and 12*c***.

It will be appreciated that the above description is directed to a preferred embodiment of the invention and, for example, that the retaining arrangement need not specifically be a retaining clip and buckle arrangement as described above. It will be understood that other means of attachment including hooks and pins, grooves, etc. are within the scope of the invention.

The invention provides a shoe midsole that functions in a manner resembling the foot. Muscles of the back of the lower limb are attached to the bottom surface of the foot by small tendons. As the muscles contract to propel the body forward, the tendons are placed in tension. Due to the elastic nature of tendons, energy stored as tension builds during the final stages of propulsion and is theoretically released with minimal loss of energy. The elastic band performs as an artificial tendon, and the artificial tendon system functions to deflect and increase tension in the band as further described below. As the body passes over the foot and propulsion begins, flexion occurs about the metatarsal heads. With both ends of the band fixed, flexion of the shoe creates tension in the band. The stored tension is then released during the late propulsive phase, aiding the foot during toe-off. The system functions to store and return energy in a manner that may be functionally useful during running or walking and utilizes both heel strike and propulsion to store energy in the band. Adjustable band tension allows specific tuning to the needs of the wearer.

Figure 2:
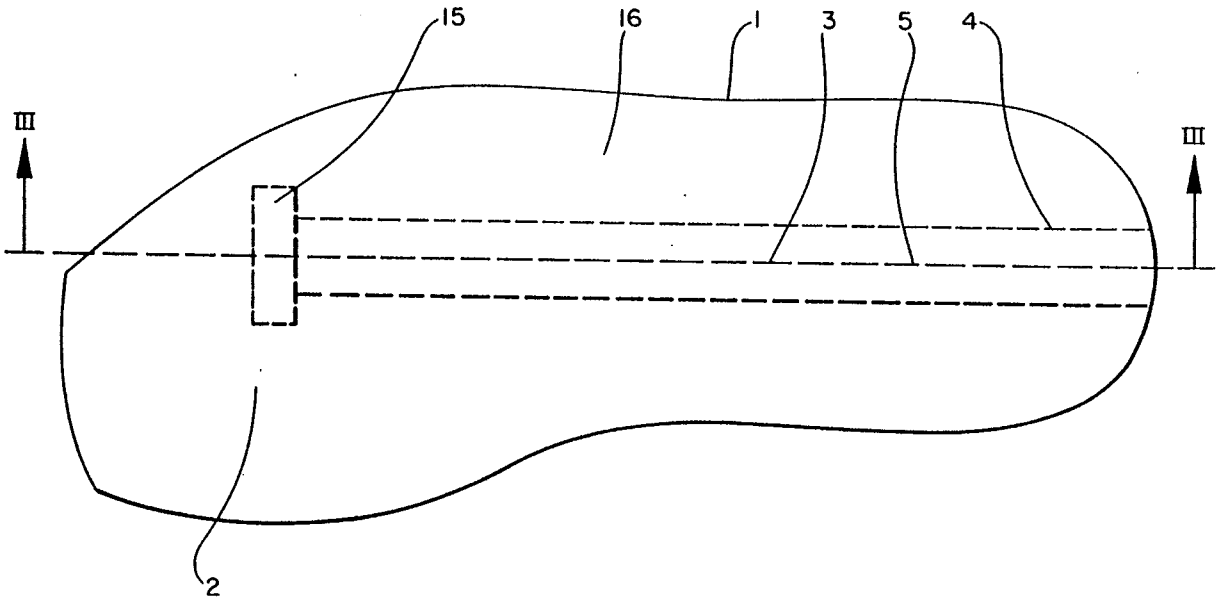
FIG. 2 shows a top plan view of the midsole shown in FIG. 1.

FIG. 2 shows the midsole 1 including the forefoot area 2 and the heel area 4 thereof. An anchor attachment member 15 is disposed in the forefoot area of the midsole 1 along the longitudinal axis thereof. One end 7 of the elastic band is secured to the anchor attachment member 15 and the elastic band passes beneath the surface 16 of the midsole 1 through the passageway 5 (shown by the dotted lines) within the midsole 1.

Figure 3:
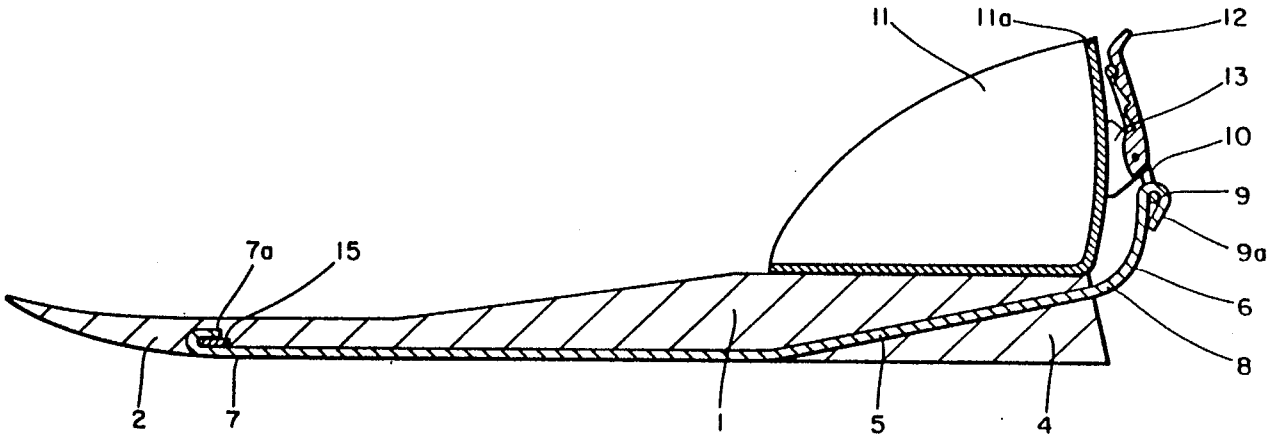
FIG. 3 shows a cross section along the line III—III of the midsole shown in FIG. 2.

FIG. 3 shows a cross section of the midsole along the line III—III which corresponds to the longitudinal axis 3 of the midsole 1 shown in FIG. 2. The elastic band 6 is shown in cross section as it extends through the passageway 5 with the interior of the midsole 1. A hook 7*a* is disposed at one end 7 of the elastic band 6 for securement to the anchor attachment member 15 in the forefoot area 2 of the misole. The elastic band 6 extends to the outside of the midsole 1 through an opening 8 in the heel area 4 of the midsole. A second hook 9*a* is disposed on the other end 9 of the elastic band 6 for attachment to the retaining clip 10. The heel counter 11 is shown in cross section as attached to the midsole 1 in the heel area 4 thereof. The buckle 12 is attached to the rear wall 11*a* of the heel counter 11 by a bracket 13.

What is claimed is:

1. A shoe including an artifical tendon system, the system comprising:

a midsole having a longitudinal axis, a heel area and a forefoot area, the midsole further including a passageway therethrough along the longitudinal axis of the midsole;

a band of elastic material, the band having one end thereof anchored proximate to the forefoot area of the midsole and extending through the passageway in the midsole, the band further including a second end; and retaining means, disposed proximate to the heel area of the midsole, for securing the second end of the band so that the band may be secured under tension when the shoe is secured on the foot of a wearer, whereby extension of the elastic material during heel strike and early propulsion creates tension in the band which tension is released during toe off.

2. A shoe according to claim 1, wherein the retaining means includes means for adjusting the amount of tension in the band.

3. A shoe according to claim 2, further comprising:

a retaining element attached to the second end of the band and wherein the retaining means further includes:

a heel counter, including an exterior wall portion;

a bracket affixed to the exterior wall portion;

a buckle arrangement pivotably attached to the bracket so that the retaining element can be removably fastened to the buckle arrangement.

4. A shoe according to claim 3, wherein the buckle arrangement further includes a series of notches so that the band may be adjustably fastened to the buckle arrangement by the retaining element, thereby providing various degrees of initial tension on the band.

* * * * *